US006594829B1

(12) United States Patent
Turkheimer

(10) Patent No.: US 6,594,829 B1
(45) Date of Patent: Jul. 22, 2003

(54) PROTECTIVE TOWEL WRAP

(76) Inventor: Lisa Turkheimer, 100 E. Clinton Ave., Oaklyn, NJ (US) 08107

( * ) Notice: Subject to any disclaimer, the term of this patent is extended or adjusted under 35 U.S.C. 154(b) by 0 days.

(21) Appl. No.: 09/683,517

(22) Filed: Jan. 11, 2002

(51) Int. Cl.[7] ..... A41B 1/00
(52) U.S. Cl. ..... 2/80; 2/69
(58) Field of Search ..... 2/80, 83, 104, 2/69, 88, 51, 50, 46, 52, 49.1–49.4, 48, 69.5, 912, 915, 914, 919, 920, 84; 15/208, 209.1, 210.1; 5/417–420

(56) References Cited

U.S. PATENT DOCUMENTS 2,227,751 A * 1/1941 Idelman ..... 2/83
2,258,946 A * 10/1941 Chadwick ..... 2/46
2,292,600 A * 8/1942 Baum ..... 2/69
2,399,782 A * 5/1946 Asher ..... 2/80
2,654,092 A * 10/1953 Brennish ..... 2/46
5,220,692 A * 6/1993 Cox ..... 2/48
5,243,724 A * 9/1993 Barnes ..... 2/69.5 X
5,321,863 A * 6/1994 Yamaguchi et al. ..... 2/69.5 X
5,479,662 A * 1/1996 Runco ..... 2/104
5,664,258 A * 9/1997 Harris ..... 2/84
5,735,004 A * 4/1998 Wooten et al. ..... 2/69
5,855,021 A * 1/1999 Somerville ..... 2/84
5,956,762 A * 9/1999 Adams ..... 2/48

* cited by examiner

*Primary Examiner*—Gloria M. Hale
(74) *Attorney, Agent, or Firm*—Greenberg & Lieberman; Michael L. Greenberg, Esq.

(57) ABSTRACT

A protective towel wrap for adults bathing infants and/or children of preschool age. There are three components of the present invention, a rectangular towel portion, a removable strap, and a separate optional hat. The caregiver can use the removable strap to attach the rectangular towel portion to their body and protect them from water while bathing the infant. The rectangular towel portion can then be used to dry the infant, and the separate optional hat can be applied to the child's head for drying, and to keep body heat in the child.

8 Claims, 3 Drawing Sheets

PROTECTIVE TOWEL WRAP

BACKGROUND OF INVENTION

The present invention is a towel wrap with removable strap for an adult bathing an infant. More specifically it is a protective towel wrap to keep the adult dry while bathing a child, and a towel for drying the baby once bathing has finished.

Currently there are hooded towels on the market that are for adults bathing infants to wrap around the baby coming out of the bath. These towels have a hood mechanism to fit around the back of the baby's head. When the infant is small and cannot walk the adult can kneel beside the tub, drape the towel across their knees and then lift the child out of the tub and onto the towel. However, even the smallest child can kick and wiggle when being picked up by the adult. Also, the child is very slippery and it can be difficult to lift the child from the bath without dropping the child, and a wiggling baby can make the task close to impossible.

As the child reaches toddler and pre-school age, they become harder to handle at bath time. They can remove themselves from the bathtub and get away from their parents or guardians and out of the bathroom before being properly dried, or in some cases dried at all. In these cases the parent must hold the child with one hand, and attempt to reach the towel with the other hand. In this process, the child can become cold as they have been removed from the bath, and often begin to cry, or whine about the cold.

U.S. Pat. No. 4,330,887 issued to White, on May 25, 1982 shows terry cloth gloves. White's invention is unlike the present invention because it does not provide a towel apparatus that can be attached to an adult while drying a baby. White's invention only provides coverage for the adult's hands and arms while bathing a baby and does not provide the adult with possible coverage of their clothes, or any exposed area that they choose.

U.S. Des. Pat. No. 277,352 issued to Klein, on Jan. 29, 1985 shows a baby towel. Klein's invention is unlike the present invention because it is a towel with a measuring device as part of its design. Klein's invention also does not have a removable strap or hood, and it has no means of attaching the towel to an adult or child.

U.S. Pat. No. 5,321,863 issued to Yamaguchi, et al., on Jun. 21, 1994 shows a bath towel for babies. Yamaguchi's invention is unlike the present invention because it does not provide a removable strap for attaching the towel to an adult, and it is intended to dry the baby after the bath and does not provide for a means to keep the adult dry while bathing the baby.

U.S. Des. Pat. No. 398,140 issued to Lion on Sep. 15, 1998 shows a baby apron towel. Lion's invention is unlike the present invention because it does not have a removable strap, and the strap is not of an appropriate length to fit around an adult to keep the adult dry while bathing the baby.

U.S. Pat. No. 5,933,886 issued to Washington, on Aug. 10, 1999 shows a baby blanket. Washington's invention is unlike the present invention because it does not have a means for keeping an adult dry while bathing an infant, or a means for drying a baby after a bath. Also Washington's invention does not provide a means for attaching a towel to an adult while bathing an infant.

U.S. Pat. No. 6,055,686 issued to Knight on May 2, 2000 shows a baby bunting for use in an infant carrier. Knight's invention is unlike the present invention because it is a blanket fitted for an infant carrier, and does not provide a means for keeping an adult dry while bathing a baby, or for drying a baby after a bath.

U.S. Pat. No. 6,266,821 issued to Quintana, on Jul. 31, 2001 shows a baby blanket. Quintana's invention is unlike the present invention because it is a closable blanket for wrapping a baby for warmth. Quintana's invention does not have a means for keeping an adult dry while bathing a baby, to dry the baby, and does not have a removable strap as does the present invention.

Therefore a need has been established for a towel apparatus that an adult may wear while bathing a baby to keep themselves dry, and also to use to dry the infant after bathing. Further there is a need for a towel apparatus with removable strap sufficient to fit around an adult, and for easy drying of the infant.

SUMMARY OF INVENTION

The present invention is a protective towel wrap having three primary pieces; a rectangular towel piece, a removable strap having hook and loop closures, and an optional separate hat for drying an infant's head, or merely keeping the child's head warm during drying. The rectangular towel piece can be removably attached to an adult by use of the removable strap. The adult can choose the part of their body that is most likely to get wet while bathing the child and use the strap to attach the towel to that section of their body. The optional separate hat allows the caregiver to attach the hat to the child's head and to wrap the child in the towel for drying purposes.

The towel is of adequate size to cover the upper portion of an adult or to wrap around a child infant through pre-school age—for drying purposes. Although the removable strap is used around the neck of the caregiver to attach the towel, it is feasible for the caregiver to attach the removable strap around their waist or other desired places, to keep particular parts of their clothing or body dry. The optional separate hat is of adequate size to fit on an infant or toddler's head. The adult can also use the towel when lifting the child from the bath to help with maneuvering a slippery child. The adult may remove the towel from their body after bathing the child and wrap the child in the towel. Alternately, while wearing the towel they may place their hands on the underside of the towel and lift the child with the towel in the space between the adult and the towel. In this manner the adult can continue to protect their clothing from dampness, and cradle the child in their arms during the drying process.

The present invention eases the bathing process because the adult does not need to search for a towel after bathing an infant. The caregiver of a toddler does not have to worry about the child standing cold and wet, or getting away from them before they have had a chance to locate a towel and dry the child. They can easily pick the child up from the bathtub and wrap them in the towel. Due to the removable strap the user can pull the towel from the strap in an easy manner, to remove it from them and apply to the child. The strap has hook and loop closures for attaching one end of the strap to the other.

The rectangular towel portion can be constructed of terry cloth or any other applicable absorbent fabric. The top edge of the towel is made of any material that can communicate with a hook and loop closure apparatus as is fixedly attached to the removable strap. The optional separate hat is made of terry cloth or any other applicable material, which is absorbent and can be used on a child's head. The removable strap is a double layer material with hook and loop fastener portions at the base on each end of the strap.

By wearing the present invention around their neck, the adult has both hands free of obstruction while bathing the child or removing them from the tub. Babies, like adults lose much of their body heat through their heads, and the separate optional hat can be applied to dry the child's hair and help to keep them warm while being dried.

Often a new mother or father during bathing time needs to use two towels, one wrapped around themselves and one for the baby. This can become cumbersome when attempting to move, wash, rinse, or pick up a wet baby, as the towel wrapped around the parent can fall, or become entangled as the adult attempts to lift the baby from the bath.

Use of the removable neck strap and its communication means of the hook and loop closures attach the towel portion of the present invention to the caregiver. The towel portion is held in a secure yet removable manner around the neck of the caregiver by attaching the hook and loop fasteners to the fabric at the top of the towel. The separate optional hat can be rolled along the rim, to fit young babies, and unrolled to fit an older child's head. The removable strap is a double layer fabric and can be constructed of the same type of fabric as the towel portion. It is a double layer fabric for resistance to breakage, and to provide comfort to the wearer. The removable neck strap can be constructed of any strong non-irritating material.

DETAILED DESCRIPTION

The present invention is a protective towel wrap with a rectangular towel section, a removable strap, and an optional separate hood. The rectangular towel piece is large enough to fit around a pre school child or across the top of the adult bathing the child. The removable strap is of sufficient length to fit around the neck of an adult, for and attaches removably to the top of the rectangular towel section. The optional separate hat is constructed of an absorbent material and has an adjustable rim to fit a small or larger child.

Figure 1:
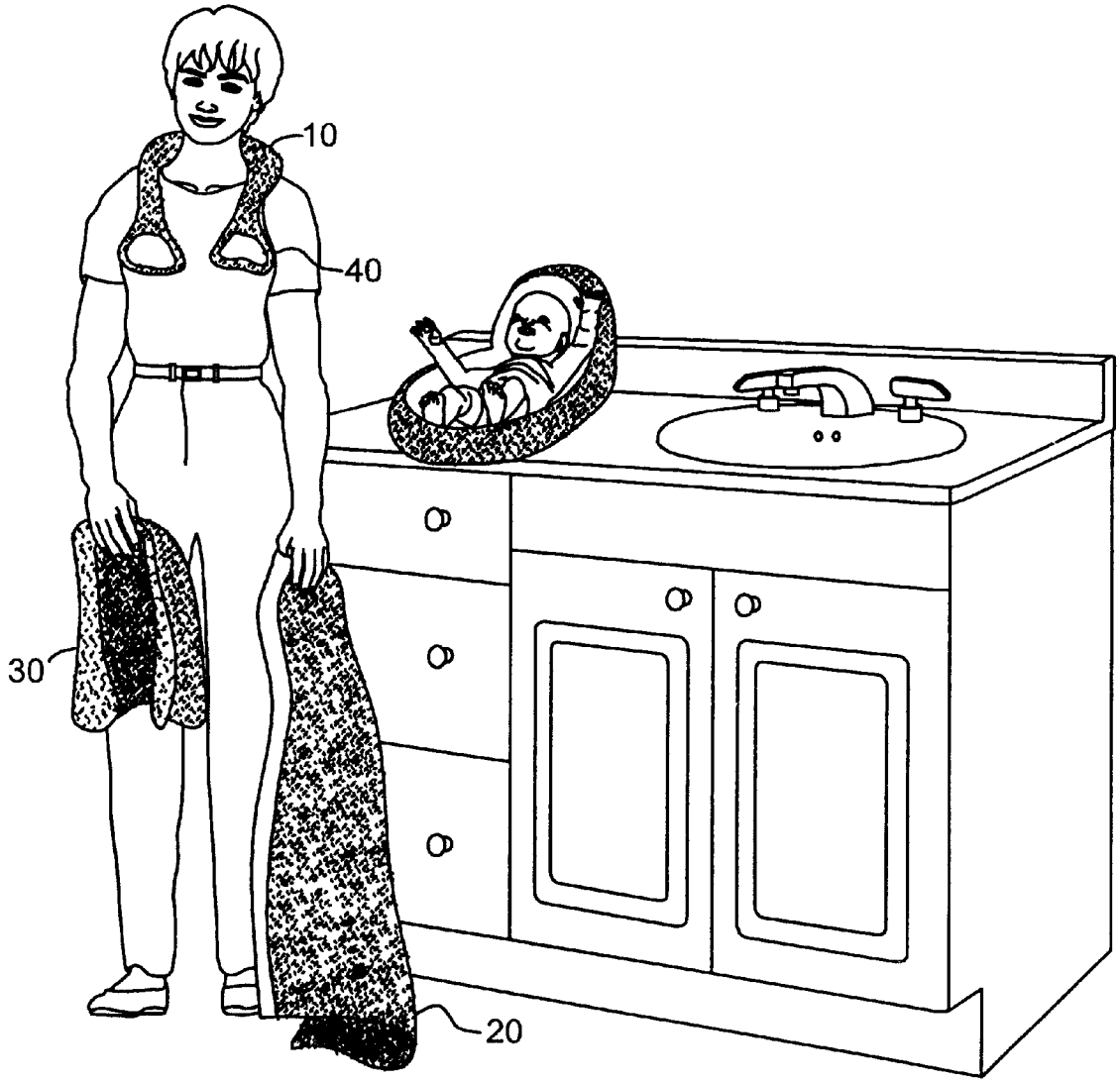
FIG. 1 shows the towel portion, neck strap, and hat.

FIG. 1 shows a caregiver wearing the removable strap (10), and holding the rectangular towel section (20) and the separate optional hat (30). In the present embodiment, the removable strap (10) is made of the same absorbent material as the rectangular towel section (20); however, the removable towel section (20) can be made of any non-irritating material in alternative embodiments. The rectangular towel section (20) is made of an absorbent machine washable material. In the present embodiment, the rectangular towel section (20) is made of a cotton terry cloth material, but the rectangular towel section (20) can be constructed of any absorbent material. The rectangular towel section (20) has an upper end that communicates detachedly with the removable strap (10). The removable strap (10) has hook and loop fasteners (40) on each end for attachment to the upper portion of the rectangular towel section. The hook and loop fasteners (40) could in separate embodiments of the present invention, be replaced by hook and eye fasteners or snapping fasteners. Although each of these fastener types will function equally well, the hook and loop fasteners (40) allow for the quickest removal of the towel wrap, and require only one hand to remove the towel wrap. Also shown in FIG. 1, is the optional separate hat (30) described in detail later.

Figure 2:
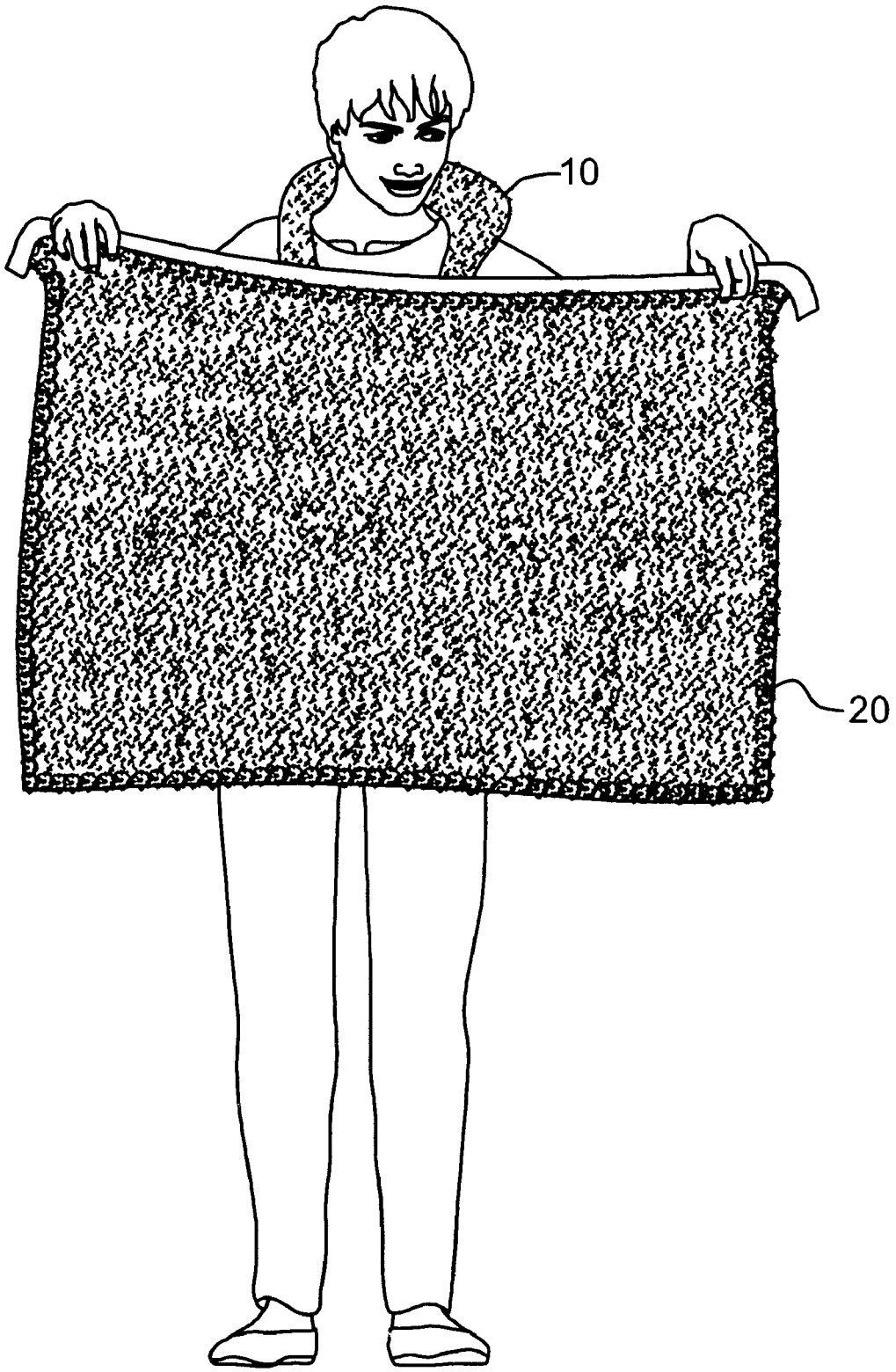
FIG. 2 shows a user wearing the removable strap and towel portion.

FIG. 2 shows a caregiver wearing the removable strap (10) and rectangular towel section (20). As is shown the caregiver places the removable strap (10) around the back of their neck and fasten the hook and loop fasteners (FIG. 1 or 2, 40) to the top of the rectangular towel section (20). Although in this figure the caregiver is shown holding the rectangular towel section (20) the towel is securely held from the user's neck by use of the removable strap (10). The caregiver can keep the top portion of their body dry by use of the removable strap (10) and the rectangular towel section (20) as shown.

Figure 3:
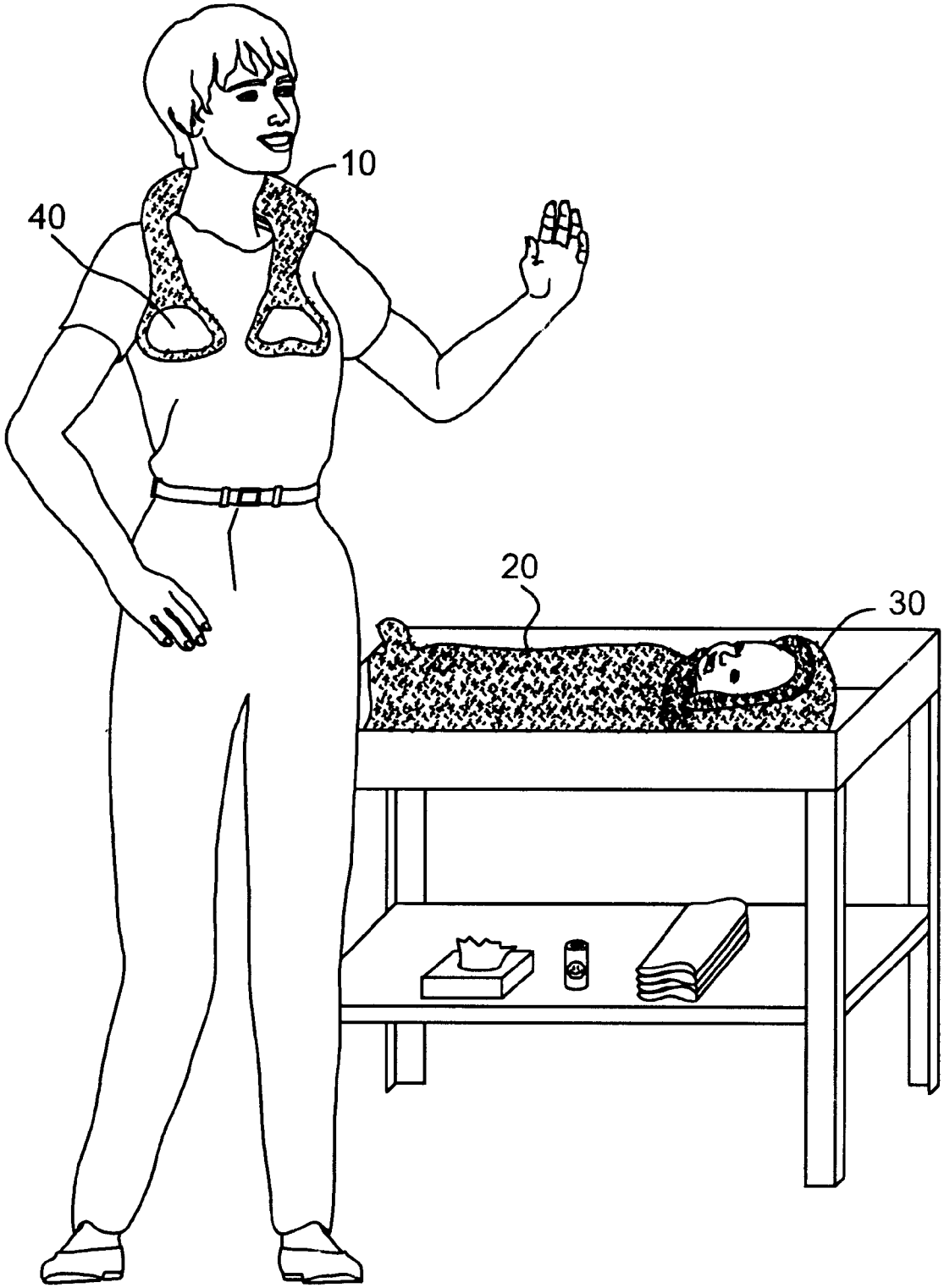
FIG. 3 shows the towel wrap and separate optional hat wrapped around a baby.

FIG. 3 shows a child wrapped in the rectangular towel portion (20) and the separate optional hat (30), as the caregiver stands by with the removable strap (10) on their neck. In this embodiment the optional hat (30) is rolled along its rim, as the child is small. If the child were older, and therefore had a larger head, the optional hat (30) could be unrolled to cover a larger portion of the child's head. In the present embodiment, the optional hat (30) is made of the same cotton terry cloth material as the rectangular towel portion (20). The optional hat (30) allows the caregiver to dry the child head, and to prevent excess heat from escaping from the child's head during the drying process. As shown in FIG. 3, the child is securely wrapped in the rectangular towel portion (20) and the optional hat (30).

The present invention is not limited to the sole embodiments described above, but encompasses any and all embodiments of the following claims.

What is claimed is:

1. A protective towel wrap, comprising:

a towel member;

a strap member, removably attached to said towel member;

a series of fasteners, for removably attaching said towel member to said strap member; and a separate hat.

2. A protective towel wrap as in claim 1, wherein said series of fasteners are hook and loop fabric fasteners.

3. A protective towel wrap as in claim 1, wherein said towel member is manufactured of an absorbent fabric material.

4. A protective towel wrap as in claim 1, wherein said separate hat is manufactured of an absorbent material.

5. A protective towel wrap, comprising:

a towel member;

a strap member removably attached to said towel member, wherein said strap member is wider at the ends than in the midsection;

a series of fasteners for removably attaching said towel member to said strap member and a hat.

6. A protective towel member as in claim 1, wherein said towel member has a top portion that extends on both the front and back of said towel member.

7. A protective member as in claim 6, wherein said series of fasteners can be attached on either a front or back of said top portion of said towel member.

8. A method of using a protective towel wrap and hat combination after bathing comprising the steps of:

placing a strap around a user's neck; attaching a towel to the strap;

placing the towel across the front of a user's body to dry and cover a bather; and placing a hat on the user's head to keep the bather warm and to protect the bather and user's body and clothing from wetness.

* * * * *